US010777347B2

(12) United States Patent
Nakamura et al.

(10) Patent No.: US 10,777,347 B2
(45) **Date of Patent: *Sep. 15, 2020**

(54) MAGNETIC ELEMENT

(71) Applicant: SUMIDA CORPORATION, Chuo-Ku, Tokyo (JP)

(72) Inventors: Akihiko Nakamura, Natori (JP); Mitsugu Kawarai, Natori (JP)

(73) Assignee: SUMIDA CORPORATION (JP)

( * ) Notice: Subject to any disclaimer, the term of this patent is extended or adjusted under 35 U.S.C. 154(b) by 240 days.

This patent is subject to a terminal disclaimer.

(21) Appl. No.: 15/855,708

(22) Filed: Dec. 27, 2017

(65) Prior Publication Data

US 2018/0151286 A1 May 31, 2018

Related U.S. Application Data

(63) Continuation of application No. 15/063,712, filed on Mar. 8, 2016, now Pat. No. 9,887,033.

(30) Foreign Application Priority Data

Mar. 11, 2015 (JP) ..... 2015-048343

(51) Int. Cl.

| | |
|---|---|
| ***H01F 41/02*** | (2006.01) |
| ***H01F 27/28*** | (2006.01) |
| ***H01F 27/255*** | (2006.01) |
| ***H01F 3/08*** | (2006.01) |
| ***H01F 27/29*** | (2006.01) |

(52) U.S. Cl.

CPC ..... *H01F 27/255* (2013.01); *H01F 3/08* (2013.01); *H01F 27/2823* (2013.01); *H01F 27/292* (2013.01); *H01F 41/0246* (2013.01)

(58) Field of Classification Search

None

See application file for complete search history.

(56) References Cited

U.S. PATENT DOCUMENTS

| | | | | |
|---|---|---|---|---|
| 5,160,447 | A | 11/1992 | Ishikawa et al. | |
| 8,277,679 | B2 | 10/2012 | Nakamura et al. | |
| 9,117,582 | B2 | 8/2015 | Nakamura | |
| 9,887,033 | B2 * | 2/2018 | Nakamura | H01F 27/292 |

(Continued)

FOREIGN PATENT DOCUMENTS

| | | | |
|---|---|---|---|
| EP | 1150312 | A2 | 10/2001 |
| JP | 2005-136164 | A | 5/2005 |

(Continued)

OTHER PUBLICATIONS

Extended European Search Report for EP Application No. 16157053.6, dated Aug. 4, 2016 (7 pages).

*Primary Examiner* — Kevin M Bernatz

(74) *Attorney, Agent, or Firm* — Harness, Dickey & Pierce, P.L.C.

(57) ABSTRACT

A magnetic element including: a core including magnetic powders of volume occupancy within the range of 60-volume % to 80-volume % with respect to the whole volume, including a binder resin of volume occupancy of 12-volume % or more with respect to the whole volume and further including vacancy of volume occupancy of 8-volume % or more with respect to the whole volume; and a coil which is formed by winding a conductive wire and concurrently, which is buried into the core.

9 Claims, 6 Drawing Sheets

(56) References Cited

U.S. PATENT DOCUMENTS

| | | | |
|---|---|---|---|
| 2003/0047245 | A1 | 3/2003 | Takemoto et al. |
| 2006/0186978 | A1 | 8/2006 | Kawarai |
| 2013/0135072 | A1 | 5/2013 | Inaba |
| 2014/0218147 | A1 | 8/2014 | Chatani et al. |
| 2015/0287507 | A1 | 10/2015 | Nishio et al. |

FOREIGN PATENT DOCUMENTS

| | | | |
|---|---|---|---|
| JP | 2007-081305 | A | 3/2007 |
| JP | 2012-169538 | A | 9/2012 |
| JP | 5978766 | B2 | 8/2016 |

* cited by examiner

MAGNETIC ELEMENT

CROSS REFERENCES TO RELATED APPLICATIONS

This is a continuation patent application of U.S. application Ser. No. 15/063,712, filed on Mar. 8, 2016, now U.S. Pat. No. 9,887,033 issued Feb. 6, 2018, which claims priority to Japanese Patent Application 2015-048343, filed on Mar. 11, 2015. The entire contents of the above applications are incorporated herein by reference.

BACKGROUND OF THE INVENTION

Field of the Invention

The present invention relates to a magnetic element and a manufacturing method of the magnetic element.

Description of the Related Art

For example, as a magnetic element of an inductor or the like, there exists such a type as shown in Patent Document 1 (Japanese unexamined patent publication No. 2007-081305). The type of the magnetic element shown in the Patent Document 1 is provided with an air-core coil and a core containing this air-core coil in the inside thereof in which the core is constituted by a mixture of magnetic powders and a resin. In addition, terminal-ends of the air-core are connected electrically to terminal electrodes.

SUMMARY OF THE INVENTION

Meanwhile, the magnetic element such as disclosed in the above-described Patent Document 1 has hygroscopicity. For this reason, unless countermeasures are applied with respect to the hygroscopicity, moisture which enters into the inside of the magnetic element is vaporized on an occasion of, for example, a solder reflow of high-temperature like 260 degrees, and there exists a defect in which volume expansion occurs in the core caused by that phenomenon and so on, crack occurs in the core or the like. In particular, when a conductive wire provided with a fusion-bond layer is used in order to form a coil and the conductive wire provided with the fusion-bond layer is rich in hygroscopicity so that a problem becomes remarkable. Then, when the volume expansion of the core and the crack of the core occur as described above, there occurs such a defect in which the inductance of the magnetic element will be decreased or the like.

Then, it is required particularly for the magnetic element which is mounted by the solder reflow to measure the product appearance and the product inductance-change rate by employing a MSL (Moisture Level: Moisture Sensitivity Level) test.

On the other hand, in recent years, the requirement with respect to the MSL has become severe for the magnetic element and in the MSL test, for example, there has been required such as level "1" which means that the magnetic element can keep its performance even it is left in the external environment without time limit. However, for the magnetic element disclosed in the Patent Document 1, it is difficult to realize such a magnetic element. More specifically, it is not possible, based on the Patent Document 1, to realize a magnetic element in which the moisture entering into the inside can be easily discharged from the magnetic element at the time of the high-temperature solder reflow.

The present invention was invented in view of such a problem and is addressed to provide a magnetic element and a manufacturing method of the magnetic element in which even under a high-temperature environment, it is possible to easily discharge the moisture which entered into the inside.

A first viewpoint of the present invention provides a magnetic element including: a core including magnetic powders of volume occupancy within the range of 60-volume % to 80-volume % with respect to the whole volume, including a binder resin of volume occupancy of 12-volume % or more with respect to the whole volume and further including vacancy of volume occupancy of 8-volume % or more with respect to the whole volume; and a coil which is formed by winding a conductive wire and concurrently, which is buried into the core.

In addition, for another aspect of the magnetic element of the present invention, it is more preferable, in addition to the above-described invention, that when assuming that the total volume occupancy of the magnetic powders, the binder resin and the vacancy is 100-volume %, the volume occupancy of the binder resin is within the range of 12-volume % to 32-volume % with respect to the whole volume, and the volume occupancy of the vacancy is within the range of 8-volume % to 28-volume % with respect to the whole volume.

Further, for another aspect of the magnetic element of the present invention, it is more preferable, in addition to the above-described invention, that the binder resin is either one of a silicone resin and an epoxy resin.

In addition, for another aspect of the magnetic element of the present invention, it is more preferable, in addition to the above-described invention, that gas permeability coefficient is 600 $cm^3 \cdot mm/(m^2 \cdot sec \cdot atm)$ or more.

Further, for another aspect of the magnetic element of the present invention, it is more preferable, in addition to the above-described invention, that the volume occupancy of the magnetic powders is within the range of 65-volume % to 75-volume %.

Further, for another aspect of the magnetic element of the present invention, it is more preferable, in addition to the above-described invention, that there is included a terminal unit which is electrically connected to a terminal-end of the coil and is attached to the outer circumferential surface of the core, and concurrently, which is attached in a state of being electrically connected with respect to an external mounting substrate.

In addition, according to a second viewpoint of the present invention, there is provided a manufacturing method of a magnetic element comprising the steps of: forming a mixture by adding magnetic powders and a binder resin within the range in which the ratio of the volume occupancies is 3/20 to 8/15 when the magnetic powders are made to be denominator and the binder resin is made to be numerator; setting a coil inside a tubular-shaped portion of a mold; further setting a terminal unit connected electrically to the coil and exposed from a core after molding and concurrently, filling the mixture inside the tubular-shaped portion of the mold; and molding a core by compressing the mixture which is filled in the step of filling; wherein in the step of molding a core, the core is molded such that the volume occupancy of vacancy with respect to the core falls within the range of 8-volume % to 28-volume % by adjusting the pressure which compresses the mixture.

According to the present invention, it becomes possible in a magnetic element to easily discharge the moisture, which entered into the inside, even under a high-temperature environment.

DESCRIPTION OF THE PREFERRED EMBODIMENTS

Figure 1:
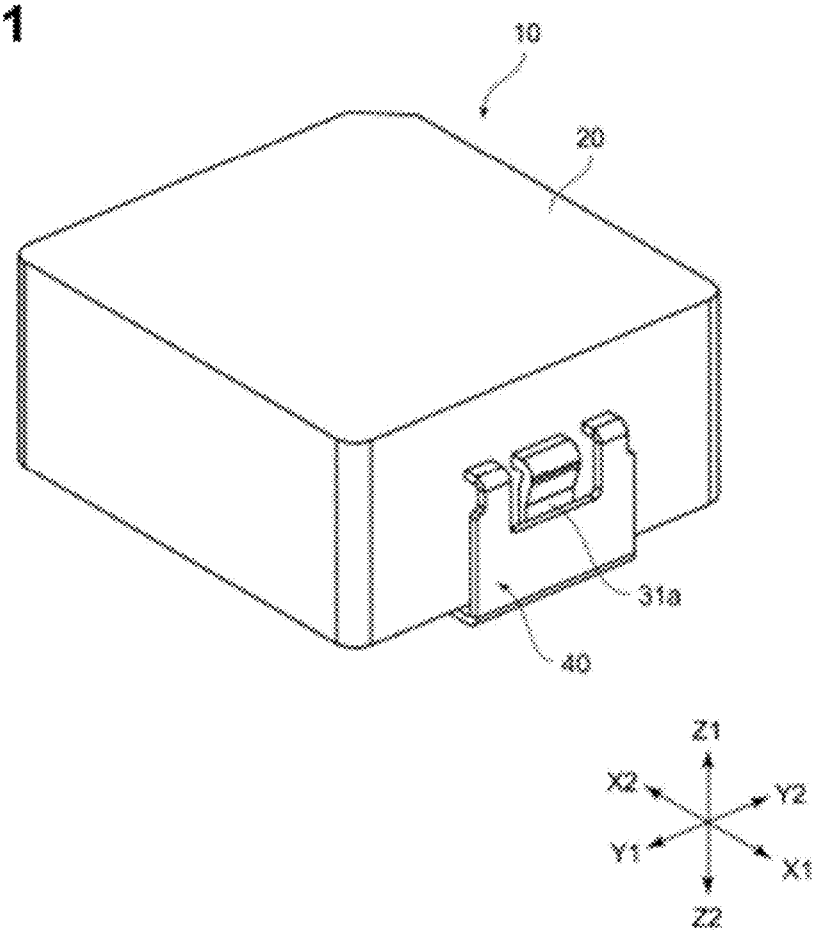
FIG. 1 is a perspective view showing a constitution of a magnetic element according to one exemplified embodiment of the present invention.
Figure 3:
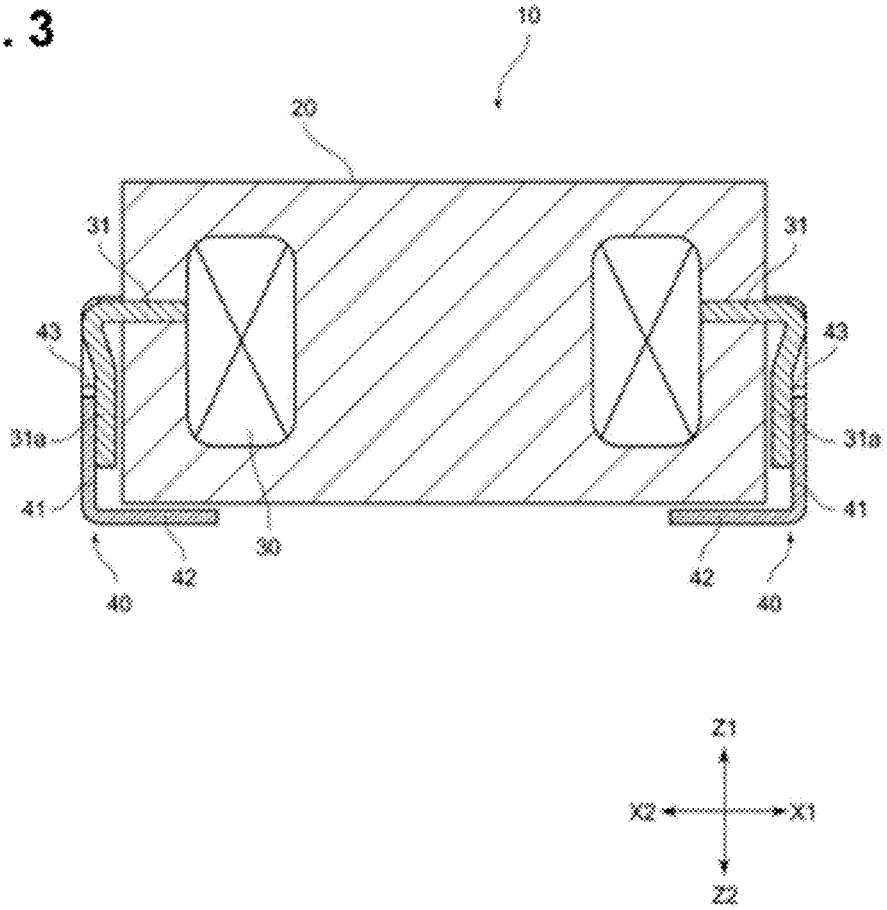
FIG. 3 is a cross-sectional side view showing a constitution of the magnetic element in FIG. 1.

Hereinafter, there will be explained a magnetic element 10 relating to one exemplified embodiment of the present invention based on the drawings. It should be noted that in the following explanation, it is supposed that there will exist explanations by using XYZ orthogonal coordinate system, in which X direction is made to be the direction coupling terminal units 40 in FIG. 3, the right side in FIG. 3 is made to be X1 side and the left side therein is made to be X2 side. In addition, the width direction of the terminal unit 40 in FIG. 1 is made to be Y direction, the left near side in FIG. 1 is made to be Y1 side and the right rear side therein is made to be Y2 side. In addition, the thickness direction of the magnetic element 10 in FIG. 1 is made to be Z direction in which the upper side thereof is made to be Z1 side and the lower side thereof is made to be Z2 side.

<1. With Regard to Constitution of Magnetic Element 10>

Figure 2:
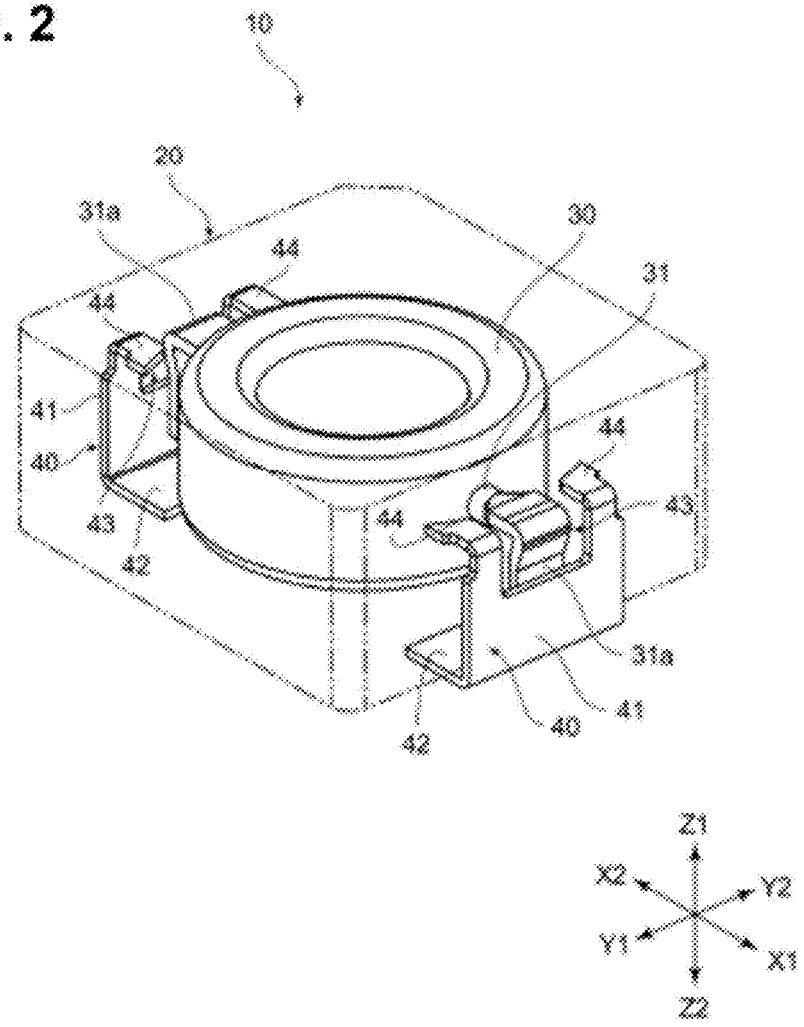
FIG. 2 is a perspective view transparently showing an internal constitution of the magnetic element in FIG. 1.

FIG. 1 is a perspective view showing a constitution of a magnetic element 10 according to this exemplified embodiment. FIG. 2 is a perspective view transparently showing an internal constitution of the magnetic element 10 according to this exemplified embodiment. FIG. 3 is a cross-sectional side view showing a constitution of the magnetic element 10 according to this exemplified embodiment.

As shown in FIGS. 1 to 3, the magnetic element 10 includes a core 20, a coil 30 and a terminal unit 40. The magnetic element 10 in this exemplified embodiment is a coil-enclosed type magnetic element in which the coil 30 is buried into the inside of the core 20. For that purpose, when molding the core 20, the coil 30 is placed in a tubular-shaped portion P which is formed by an upper-side die 101 and a lower-side die 102 of a mold 100 (see FIG. 5), further, the terminal unit 40 or the terminal ends of the coil 30 are to be sandwiched between the upper-side die 101 and the lower-side die 102 and thereafter, the core 20 is pressure-molded by filling a mixture of magnetic powders and a binder resin in the tubular-shaped portion.

The coil 30 is constituted by winding a conductive wire 31. According to the constitution shown in FIGS. 1 to 3, the conductive wire 31 is a round wire, in which terminal ends 31*a* of that conductive wire 31 are protruded from the inside of the core 20 to the outside thereof.

The conductive wire 31 constituting this coil 30 is provided with a metal conductive portion such as copper, an insulation layer such as enamel or the like which covers that metal conductive portion and a fusion-bond layer which covers the insulation layer. The fusion-bond layer is a portion which melts the adjacent conductive wires 31 each other in a state in which the conductive wire 31 is laminated by the winding thereof. In this manner, the adjacent conductive wires 31 are fixed each other and the coil 30 is prevented from being unfastened.

It should be noted for the fusion-bond layer that there exist a fusion-bond layer of a type in which the conductive wires 31 are fusion-bonded each other by the heating thereof (for example, a type in which the fusion-bond layer is constituted by polyamide-based resin), a fusion-bond layer of a type in which the conductive wires 31 are fusion-bonded each other by attaching solvent such as alcohol or the like (for example, a type in which the fusion-bond layer is constituted by soluble polyamide-based resin), and the like, but it is allowed to use any type if the conductive wires 31 are fusion-bonded each other. The coil 30 using the conductive wire 31 provided with such a fusion-bond layer includes a fusion-bond layer and therefore, the coil has a higher hygroscopicity thereof is high compared with that using a conductive wire without a fusion-bond layer.

The terminal unit 40 is a portion which is attached to the outer surface of the core 20 and a portion which is connected electrically with respect to an external mounting substrate. For this reason, the terminal unit 40 includes a side-surface attachment portion 41 positioned at the side surface of the core and a bottom-surface mount portion 42 positioned at the bottom surface of the core 20. In addition, there is provided also a terminal cut-out portion 43 for the terminal unit 40. The terminal cut-out portion 43 is a portion formed by notching the terminal unit 40 so as to make the terminal end 31*a* positioned therein. When the terminal end 31*a* is made to be positioned in this terminal cut-out portion 43, the terminal unit 40 is connected electrically with respect to the terminal end 31*a*. According to the constitution shown in FIGS. 1 to 3, the terminal unit 40 is connected electrically with respect to the terminal end 31*a* at the outer surface of the core 20 by a technique of, for example, soldering, laser welding or the like.

It should be noted that as shown in FIG. 2, a portion of the terminal unit 40 includes a buried portion 44 which enters into the inside of the core 20, but it is allowed not to employ such a configuration including the buried portion 44.

It should be noted that the description above relates to one example of a constitution of the magnetic element 10, but it is allowed not to employ such a configuration as shown in FIGS. 1 to 3. For example, also for the conductive wire without being provided with the fusion-bond layer, the insulation layer thereof has hygroscopicity and therefore, a similar problem occurs. In addition, also the core 20 is provided with hygroscopicity. Consequently, even in case of using a constitution in which a coil using a conductive wire without the existence of a fusion-bond layer is buried into the inside of the core or even in case of using a non-buried type core in which the coil is not buried into the inside of the core, it is needless to say that the present invention is applicable thereto.

<2. With Regard to Composition of Core 20>

Next, there will be explained a composition of the core 20. The core 20 of this exemplified embodiment is a mixture obtained by mixing magnetic powders and a binder resin.

Specifically, the magnetic powders are soft-magnetic metal powders and it is preferable to employ Fe-based metal powders, for example, from a viewpoint of magnetic characteristic, easy availability or the like and among those powders, there can be cited Fe—Si—Al-based powders (sendust), Fe—Ni-based powders (permalloy), Fe—Cobased powders (permendur), Fe—Si—Cr-based powders, Fe—Si-based silicon steel, Fe-based amorphous powders and the like. In addition, it is also allowed to employ a mixture formed by two kinds or more of the abovementioned magnetic powders.

Among those above, it is preferable to use the Fe—Si—Cr-based powders in order to obtain a necessary magnetic characteristic. It should be noted that it is preferable for the grain diameter of the magnetic powders to be 5 μm to 30 μm. In addition, there is no limitation for the grain shape of the magnetic powders in particular and it is enough if an approximately spherical shape, a flat shape or the like is to be selected in compliance with the aimed usage.

In addition, for the binder resin, there can be cited silicone resin, epoxy resin, PES (Poly-Ethel-Sulfone) resin, PAI (Polyamide-Imide) resin, PEEK (Poly-Ethel-Ethel-Ketone) resin, phenol resin and the like, but it is also allowed to use a resin for the binder resin other than those above. Among them, it is preferable to employ the silicone resin or the epoxy resin from a viewpoint of easy availability, heat resistance or the like.

In addition, to form the core 20, it is preferable for the volume occupancy which the magnetic powders occupy in the core 20 to satisfy the following conditions (1) to (3) when the total of the magnetic powders, the binder resin and the vacancy is assumed to be 100-volume %.

(1) It is preferable for the volume occupancy of the magnetic powders to be within the range of 60-volume % to 80-volume %. When the percentage of the magnetic powders occupying the core 20 (volume occupancy) is smaller than 60-volume %, the product inductance (Ls) also becomes lower than the threshold value for judgement and this situation is not preferable.

In addition, when the percentage of the magnetic powders occupying the core 20 becomes larger than 80-volume %, according to the conditions (2) and (3) mentioned later, the percentage of the binder resin becomes smaller than 12-volume % or the percentage of the vacancy becomes smaller than 8-volume %. In this case, when the percentage of the magnetic powders occupying the core 20 is larger than 80-volume %, and also, the percentage of the binder resin becomes smaller than 12-volume %, the strength is so decreased that it becomes impossible to handle the core 20 as a molded body. This situation is not preferable.

In addition, when the percentage of the magnetic powders occupying the core 20 is larger than 80-volume %, and also, the percentage of the vacancy becomes smaller than 8-volume %, a crack occurs at the outer appearance of the core 20. This situation is not preferable. Such an occurrence of crack is caused by a phenomenon that the moisture absorbed by the fusion-bond layer or the core 20 becomes a vapor having a large volume when heating toward approximately 260 degrees at the time of the MSL test and it becomes difficult to let vaper to be discharged to the outside.

From the above description, it is preferable for the percentage of the magnetic powders to be within the range of 60-volume % to 80-volume %.

It should be noted that it is more preferable if the percentage of the magnetic powders is within the range of 65-volume % to 75-volume %. In this case, it is possible to increase the value of the product inductance (Ls) as much as approximately around 1.5 times compared with a case in which the percentage of the magnetic powders is 60-volume %. In addition, with regard to at least one of the volume occupancies of the binder resin and the vacancy, it is possible to make the volume occupancy be a value larger than the lower limit within each permissible range and depending on this fact, it is possible to make at least one of the gas transmission and the molded-body strength of the core 20 be more favorable.

(2) In a state of satisfying the abovementioned condition (1), it is preferable for the percentage of the binder resin occupying the core 20 to be within the range of 12-volume % to 32-volume %. When the percentage of the binder resin occupying the core 20 exceeds 32-volume %, naturally, the percentage of the magnetic powders becomes smaller than 60-volume % or the percentage of the vacancy becomes smaller than 8-volume %. Here, when the percentage of the binder resin exceeds 32-volume % and also the percentage of the magnetic powders becomes smaller than 60-volume %, also the product inductance (Ls) becomes lower than the threshold value for judgement as described above. This situation is not preferable. In addition, when the percentage of the binder resin exceeds 32-volume % and also the percentage of the vacancy becomes smaller than 8-volume %, a crack occurs at the outer appearance of the core 20 of the molded body as described above. This situation is not preferable. Further in addition, there also occurs such a problem that the change rate of the inductance value (L) becomes larger than the tolerance thereof because of the occurrence of the crack.

In addition, when the percentage of the binder resin occupying the core 20 becomes smaller than 12-volume %, the strength is so decreased that it becomes impossible to handle the core 20 as a molded body as described above. This situation is not preferable. With regard to this matter, other than a case mentioned in the above description in which the percentage of the magnetic powders occupying the core 20 is larger than 80-volume %, and also, in which the percentage of the binder resin becomes smaller than 12-volume %, the strength is similarly decreased even if the percentage of the magnetic powders occupying the core 20 is within the range of 60-volume % to 80-volume %. This situation is not preferable.

From the above description, it is preferable for the percentage of the binder resin to be within the range of 12-volume % to 32-volume %.

(3) In a state of satisfying the abovementioned conditions (1) and (2), it is preferable for the vacancy rate of the core 20 to be within the range of 8-volume % to 28-volume %. If the percentage of the vacancy is smaller than 8-volume %, a crack occurs at the outer appearance of the core 20 of the molded body similarly as mentioned above. This situation is not preferable. In addition, the change rate of the inductance value (L) becomes larger than the tolerance thereof because a crack occurs at the core 20 of the molded body. With regard to this matter, other than a case mentioned in the above description in which the percentage of the magnetic powders occupying the core 20 is larger than 80-volume %, and also, in which the percentage of the vacancy becomes smaller than 8-volume %, the strength is similarly decreased even when the percentage of the magnetic powders occupying the core 20 is within the range of 60-volume % to 80-volume %. This situation is not preferable.

It should be noted that when the percentage of the vacancy is smaller than 8-volume %, the gas permeability coefficient of the gas which penetrates the core 20 decrease and therefore, even if vapor is generated in the inside of the core 20 as described above, it is difficult to discharge that vapor toward the outside.

It should be noted that when the percentage of the vacancy exceeds 28-volume %, the percentage of the magnetic powders becomes smaller than 60-volume % or the percentage of the binder resin becomes smaller than 12-volume %.

For this reason, it is preferable for the percentage of the vacancy not to exceed 28-volume %.

Figure 4:
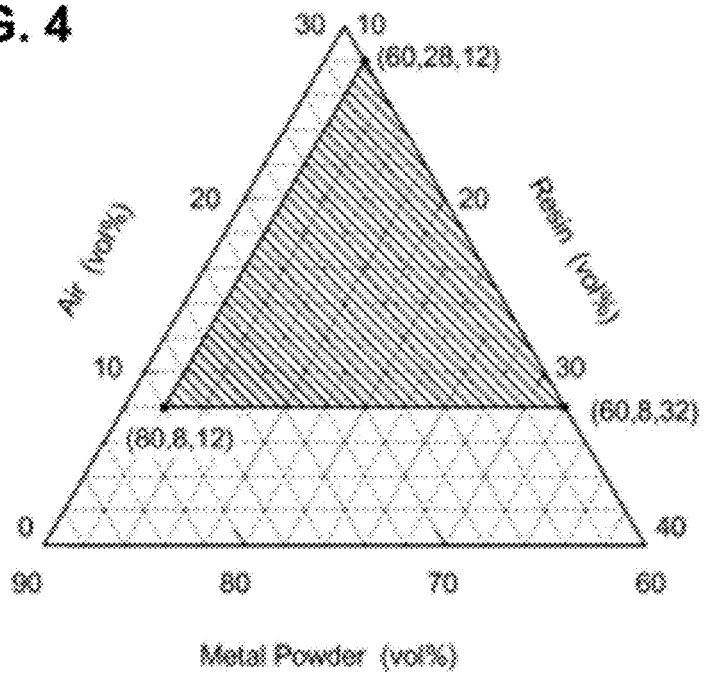
FIG. 4 is a ternary diagram showing volume occupancies of the magnetic powders, the binder resin and the vacancy in the core of this exemplified embodiment.

To summarize the situations as described above, it becomes possible to obtain the states shown in FIG. 4. FIG. 4 is a ternary diagram showing volume occupancies of the magnetic powders, the binder resin and the vacancy in the core 20. In this FIG. 4, if the volume occupancies are lying inside the hatched area, the product inductance (Ls) for the core 20 becomes higher than the threshold value for judgement. In addition, also the gas permeability coefficient becomes higher than the threshold value and it becomes possible to suppress the occurrence of the crack at the outer appearance of the core 20. Further, by suppressing the occurrence of the crack at the outer appearance of the core 20, the change rate of the inductance value (L) becomes smaller than the tolerance thereof. In addition, with regard to the core 20 after molding, it is possible to obtain strength such an extent that the handling thereof becomes possible.

Next, there will be explained a manufacturing method of the core 20 in this exemplified embodiment. First, magnetic powders and a binder resin are mixed, and the binder resin is coated on the magnetic powders (corresponding to Mixing-Process). At that time, based on the volume occupancies of the above-described magnetic powders and the binder resin, a mixture is formed by adding magnetic powders and a binder resin within the range in which the ratio of the volume occupancies is 3/20 to 8/15 when the magnetic powders are made to be denominator and the binder resin is made to be numerator.

In case of mixing such magnetic powders and binder resin, it is preferable, by using a planetary mixer or the like, to disperse them so as to be mixed uniformly.

Figure 5:
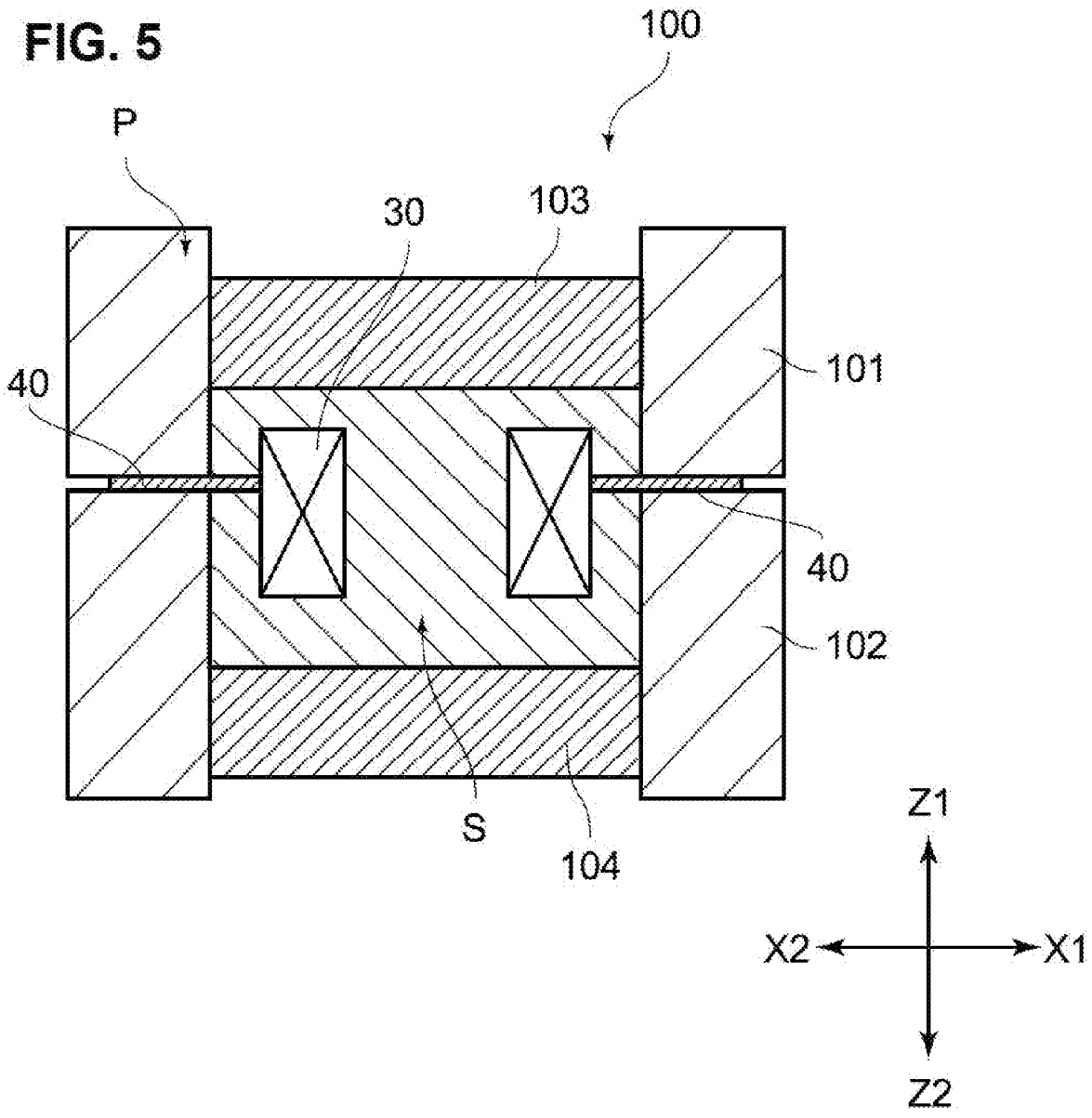
FIG. 5 shows a mold for forming the core of the magnetic element according to this exemplified embodiment.

In addition, the coil 30 formed by winding the conductive wire 31 beforehand and the terminal unit 40 formed by punching-out a metal plate are fabricated separately. Thereafter, the terminal end of the coil 30 and the terminal unit 40 are joined in an electrically conductive state, and a semi-finished product is produced. For that purpose, it is allowed to join the terminal end of the coil 30 and the terminal unit 40, for example, by soldering and it is also allowed to join them by welding such as laser welding or the like. Next, the abovementioned semi-finished product is set in a tubular-shaped portion P of the mold. For the mold, there can be cited a constitution such as shown, for example, in FIG. 5. FIG. 5 shows a mold 100 for forming the core 20 of the magnetic element 10 according to this exemplified embodiment. The mold 100 shown in FIG. 5 is provided with an upper-side die 101, a lower-side die 102, an upper-side punch 103 and a lower-side punch 104. For the upper-side die 101 and the lower-side die 102, through-holes are formed.

After this setting, the upper-side die 101 is lowered with respect to the lower-side die 102 so as to sandwich the terminal unit 40 or the terminal end of the coil 30 and there is obtained a state of sandwiching the terminal unit 40. Thereafter, there is obtained a state in which the lower-side punch 104 is positioned on the downward side of the tubular-shaped portion P which is surrounded by the upper-side die 101 and the lower-side die 102. Thereafter, a mixture of magnetic powders and a binder resin is filled (corresponding to Filling-Process).

Subsequently, from the upward side of the tubular-shaped portion P, the upper-side punch 103 is inserted and the magnetic powders are pressure-molded (corresponding to Compression-Molding-Process). At that time, by adjusting the adding pressure, it is possible to adjust the volume occupancy of the vacancy which exists inside the mixture. In this exemplified embodiment, the molding is applied by the adjustment of the pressure for compressing the mixture such that the volume occupancy of the vacancy with respect to the core 20 will fall within the range of 8-volume % to 28-volume %. In addition, according to another technique, the matter of filling how much mass of mixture to the tubular-shaped portion P was found out beforehand and therefore, also by moving the upper-side punch 103 and the lower-side punch 104 with respect to that mixture as far as the target positions inside the tubular-shaped portion P, it is possible to adjust the volume occupancy of the vacancy.

In this manner, by a pressure-molding, there is formed a core 20 which is molded to such an extent that the handling thereof is possible. It should be noted that after this pressure-molding-process, there is carried out a thermosetting-process for heating the core 20 after the molding.

In addition, after the pressure-molding-process (after the thermosetting-process in case of carrying out the thermosetting-process), the terminal unit 40 is bent so as to be directed toward the bottom-surface side of the core 20, in some cases, together with the terminal end of the coil 30. Further, the terminal unit 40 is bent so as to be positioned in a surface manner with respect to the bottom surface. In this manner, there is formed a magnetic element 10 of an SMD (Surface-Mount-Device) type.

Next, there will be explained an inventive-example for the core 20 of this exemplified embodiment.

Inventive-Example a

In an inventive-example A, for the magnetic powders, there were used mixed powders of Fe—Si—Cr-based powders and Fe-based amorphous powders and further, for the binder resin, there was used KR-251 (Product-Name) manufactured by Shin-Etsu Chemical Co., Ltd. which is a silicone resin, in which a mixture was obtained by mixing those above by a planetary mixer. Thereafter, by pressure-molding the mixture by using a mold, there was obtained a magnetic element 10 having a core 20. At that time, for the coil 30, there was used a fusion-bond copper wire manufactured by Sumitomo Electric Industries, Co., Ltd. in which the material of the insulation layer thereof is made of polyamide-imide and the material of the fusion-bond layer is made of epoxy-based resin, and the winding is applied as many as 16.5 turns so as to obtain that coil whose inner diameter thereof becomes 4.5 mm and the outer diameter thereof becomes 8.0 mm. It should be noted that the vertical size of the core 20 at that time becomes 10 mm, the horizontal size of it becomes 10 mm and the thickness size becomes 5 mm.

At that time, the measurements were carried out by variously changing the volume occupancy of the magnetic powders, the volume occupancy of the silicone resin and the volume occupancy of the vacancy. At that time, each item of density, gas permeability coefficient and product inductance (Ls) of the core 20 was measured. The threshold value for judgement of the product inductance (Ls) is 7, so that when the product inductance (Ls) was 7 or more, there was applied an acceptable-mark ("○" in Table 1) and when the product inductance (Ls) was smaller than 7, there was applied an unacceptable-mark ("x" in Table 1). It should be noted that with regard to the volume of the core 20 of the molded body, the dimensions thereof were obtained by a measurement using a venire caliper. In addition, the weight of the core 20 of the molded body was measured by using an electronic balance. Similarly, the weight of the binder resin was also measured by using the electronic balance.

Figure 6:
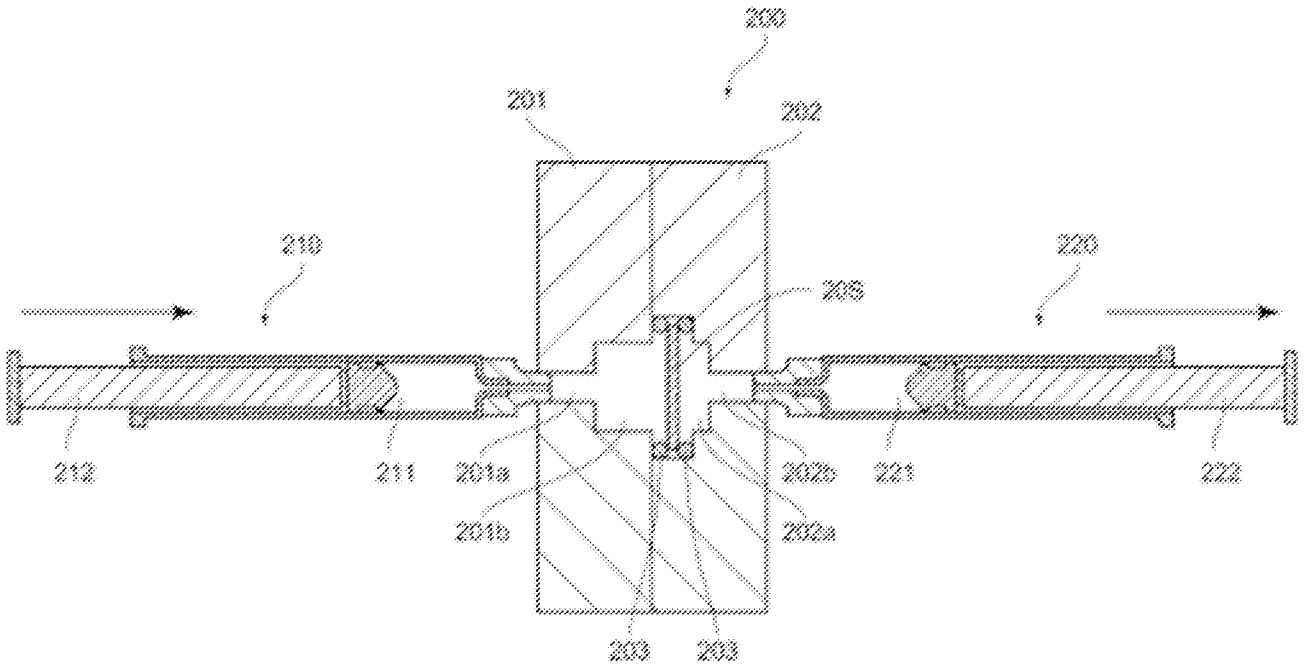
FIG. 6 is a view showing a schematic constitution of a measuring instrument for measuring gas permeability coefficient and is a side view showing a portion thereof by the cross-section.

In addition, the gas permeability coefficient is measured by using a measuring instrument 200 as shown in FIG. 6. FIG. 6 is a view showing a schematic constitution of a measuring instrument 200 for measuring a gas permeability coefficient and is a side view showing a portion thereof by the cross-section. As shown in FIG. 6, the measuring instrument 200 has a constitution in which an internal space S is formed, for example, by matching two dies 201, 202 each other. At one die 201 within those dies, there are provided an introduction path 201*a* and an expansion space 201*b* having a wider cross-sectional area compared with that introduction path 201*a*. In addition, the opening side of the introduction path 201*a* is interlinked with a pressure syringe 211 constituting a pressurizer 210. The pressurizer 210 is provided with a piston 212 which is inserted into the pressure syringe 211 in addition to the pressure syringe 211 and by pushing-in the piston 212, the air inside the pressure syringe 211 can be introduced into the internal space S by way of the introduction path 201*a*.

In addition, at the other die 202, there is provided a holding space 202*a* by which a core of the test target (named as "core 20S") is held and further, there is also provided an exhaust path 202*b*. The holding space 202*a* is provided to be wider than the expansion space 201*b*. At the holding space 202*a*, for example, there are arranged a pair of sealing members 203 such as O-rings, in which the core 20S of the test target is sandwiched and held between those pair of sealing members 203. In addition, the opening side of the exhaust path 202*b* is interlinked with an introducing cylinder 221 constituting a gas catcher 220. The gas catcher 220 is provided also with a piston 222 which is inserted into the introducing cylinder 221 in addition to the introducing cylinder 221, based on the moved amount of the piston 22 in the introducing cylinder 221, the gas which penetrated the core 20S of the test target can be weighed.

It should be noted that for the measurement of the gas permeability coefficient, the measurement is carried out under the indoor environment.

Here, in the inventive-example A, the shapes of the cores are different among the core 20S which is the test target of the gas permeability coefficient, the core for the measurement of product inductance (Ls), and the core 20 for which other tests (MSL test and test relating to molded-body strength) are carried out. More specifically, in order to measure the gas permeability coefficient, the measurement becomes a measurement depending on a measuring instrument of exclusive use such as the measuring instrument 200, so that the measurement was carried out under a condition in which the diameter of the core 20S of the test target was 12 mm and the thickness thereof was 5 mm. However, in the MSL test and the test relating to the molded-body strength, it is preferable to apply the tests using the same shapes as that of the core 20 of this exemplified, so that the tests were carried out by using the cores 20 with the same shapes as that of such a core of this exemplified embodiment.

In this inventive-example A, the measurement was carried out by using the atmospheric air as the gas. In addition, the measurement pressure (pressure difference with respect to the atmospheric pressure) was set to be 0.5 atm and while that measurement pressure is maintained, the gas introduced into the introducing cylinder 221 was measured for 10 seconds. The gas permeability coefficient is expressed by $cm^3 \cdot mm/(m^2 \cdot sec \cdot atm)$.

In addition, the MSL test is also carried out with respect to the core 20. The MSL test condition is such a condition that 24 Hr storing (with moisture removal) is applied in a 125° C. test bath and thereafter, 168 Hr storing (with moisture absorption) is applied in 85° C.-85% in a test bath and then, there is applied a test of passing-through a reflow furnace having a Peak temperature 260 degrees. Specifically, the rate by which cracks occur at an outer appearance of the core 20 (crack occurrence rate) was measured and further, also the change rate of the inductance value (L) was measured. It should be noted that in Table 1, when the crack occurrence rate is 0, there is applied an acceptable-mark ("○" in Table 1) and when the crack occurrence rate is larger than 0, there is applied an unacceptable-mark ("x" in Table 1). In addition, with regard to the change rate of the inductance value (L), an acceptable-mark ("○" in Table 1) was applied when the change rate lay within −5% and an unacceptable-mark ("x" in Table 1) was applied when the change rate of the inductance value (L) did not lie within −5%.

In addition, also the strength of the molded body of the core 20 was judged. This strength of the molded body of the core 20 was judged by whether or not it is possible to handle the molded body of the core 20. More specifically, an acceptable-mark ("○" in Table 1) was applied when it was possible to handle the core 20 and an unacceptable-mark ("x" in Table 1) was applied when it was difficult to handle the core 20.

Then, Table 1 expresses a summarized result based on the above-described each item. It should be noted in Table 1 that with regard to the inventive-examples A1 to A15, the situations thereof are under the above-described conditions of: (1) the volume occupancy of the magnetic powders is within the range of 60-volume % to 80-volume %, (2) the volume occupancy of the silicone resin which is the binder resin is within the range of 12-volume % to 32-volume % and (3) the volume occupancy of the vacancy is within the range of 8-volume % to 28-volume %, in which those volume occupancies above exist inside the area shown by being hatched in FIG. 4. On the other hand, with regard to the comparative-examples CA1 to CA9, at least one of the volume occupancy of the magnetic powders, the volume occupancy of the silicone resin and the volume occupancy of the vacancy exists outside the area shown by being hatched in FIG. 4. In addition, in Table 1, there is listed also a conventional example PA other than the comparative-examples CA1 to CA9. Also with regard to the conventional example PA, at least one of the occupancies exists outside the area shown by being hatched in FIG. 4.

TABLE 1

| Silicone resin | | | | | | | | | | | | |
|---|---|---|---|---|---|---|---|---|---|---|---|---|
| Space Factor (Vol %) | | | Density | Gas Permeability | Inductance (μH) | | MSL Test | | | | | |
| | | | | | | | Crack Occurrence | | Inductance Change | | Molded Body | |
| Metal Powder | Vacancy | Resin | g/cm³ | cm³ · mm/ (m² · sec · atm) | Result | Judgment | Rate (%) | Judgment | Rate (%) | Judgment | Strength | Remarks |
| 58 | 8 | 34 | 4.67 | 724 | 6 | X | 0 | ○ | −4 | ○ | ○ | Comparative-Example CA1 |
| 58 | 20 | 22 | 4.55 | 5174 | 6 | X | 0 | ○ | −2 | ○ | ○ | Comparative-Example CA2 |
| 58 | 30 | 12 | 4.45 | 12448 | 6 | X | 0 | ○ | −2 | ○ | ○ | Comparative-Example CA3 |
| 60 | 6 | 34 | 4.82 | 354 | 8 | ○ | 80 | X | −17 | X | ○ | Comparative-Example CA4 |
| 60 | 8 | 32 | 4.8 | 682 | 8 | ○ | 0 | ○ | −4 | ○ | ○ | Inventive-Example A1 |
| 60 | 13 | 27 | 4.75 | 2154 | 8 | ○ | 0 | ○ | −3 | ○ | ○ | Inventive-Example A2 |
| 60 | 18 | 22 | 4.7 | 4026 | 8 | ○ | 0 | ○ | −3 | ○ | ○ | Inventive-Example A3 |
| 60 | 23 | 17 | 4.65 | 7066 | 8 | ○ | 0 | ○ | −2 | ○ | ○ | Inventive-Example A4 |
| 60 | 28 | 12 | 4.6 | 10996 | 8 | ○ | 0 | ○ | −2 | ○ | ○ | Inventive-Example A5 |
| 60 | 30 | 10 | 4.58 | 12071 | 8 | ○ | 0 | ○ | −2 | ○ | X | Comparative-Example CA5 |
| 65 | 8 | 27 | 5.12 | 730 | 11 | ○ | 0 | ○ | −4 | ○ | ○ | Inventive-Example A6 |
| 65 | 13 | 22 | 5.07 | 2116 | 11 | ○ | 0 | ○ | −3 | ○ | ○ | Inventive-Example A7 |
| 65 | 18 | 17 | 5.03 | 4472 | 12 | ○ | 0 | ○ | −2 | ○ | ○ | Inventive-Example A8 |
| 65 | 23 | 12 | 4.98 | 7260 | 11 | ○ | 0 | ○ | −2 | ○ | ○ | Inventive-Example A9 |
| 70 | 6 | 24 | 5.47 | 346 | 14 | ○ | 85 | X | −20 | X | ○ | Comparative-Example CA6 |
| 70 | 8 | 22 | 5.45 | 688 | 15 | ○ | 0 | ○ | −4 | ○ | ○ | Inventive-Example A10 |
| 70 | 13 | 17 | 5.4 | 2110 | 15 | ○ | 0 | ○ | −3 | ○ | ○ | Inventive-Example A11 |
| 70 | 18 | 12 | 5.35 | 4054 | 15 | ○ | 0 | ○ | −3 | ○ | ○ | Inventive-Example A12 |
| 72 | 18 | 10 | 5.48 | 4461 | 17 | ○ | 0 | ○ | −3 | ○ | X | Comparative-Example CA7 |
| 75 | 8 | 17 | 5.77 | 689 | 18 | ○ | 0 | ○ | −4 | ○ | ○ | Inventive-Example A13 |
| 75 | 13 | 12 | 5.73 | 2201 | 19 | ○ | 0 | ○ | −3 | ○ | ○ | Inventive-Example A14 |
| 80 | 8 | 12 | 6.1 | 681 | 23 | ○ | 0 | ○ | −4 | ○ | ○ | Inventive-Example A15 |
| 82 | 6 | 12 | 6.25 | 353 | 24 | ○ | 90 | X | −23 | X | ○ | Comparative-Example CA8 |
| 82 | 8 | 10 | 6.23 | 729 | 25 | ○ | 0 | ○ | −4 | ○ | X | Comparative-Example CA9 |
| 70 | 5 | 25 | 5.48 | 206 | 15 | ○ | 86 | X | −18 | X | ○ | Conventional-Example PA |

It should be noted that in the abovementioned Table 1, the volume occupancy "A1" of the magnetic powders with respect to the molded body of the core 20 or 20S is calculated as follows. More specifically, for example, by dividing the weight "A2" of the magnetic powders within the molded body of the core 20 or 20S by the specific gravity "A3" of the magnetic powders, it is possible to calculate the volume "A4" of the magnetic powders from the weight "A2" of the magnetic powders. It is possible to calculate the volume occupancy "A1" of the magnetic powders by dividing this volume "A4" of the magnetic powders by the volume "D" of the core 20 or 20S.

In addition, the volume occupancy "B1" of the binder resin is calculated as follows. In case of adding the binder resin to the magnetic powders, by multiplying the weight percent "B2" of the additive amount of the binder resin with respect to the weight "A2" of the abovementioned magnetic powders, it is possible to calculate the weight "B3" of the binder resin. Thereafter, by dividing the weight "B3" of the binder resin by the specific gravity "B4" of the binder resin, it is possible to calculate the volume "B5" of the binder resin. In addition, by dividing the volume "B5" of the binder resin by the volume "D" of the core 20 or 20S, it is possible to calculate the volume occupancy "B1" of the binder resin.

In addition, the volume occupancy "C1" of the vacancy is found out as follows. More specifically, by subtracting the volume "A4" of the magnetic powders and the volume "B5" of the binder resin from the volume "D" of the core 20 or 20S, the volume "C2" of the vacancy can be found out. Then, by dividing the volume "C2" of the vacancy by the volume "D" of the core 20 or 20S, it is possible to calculate the volume occupancy "C1" of the vacancy.

As known from Table 1, in the inventive-examples A1 to A15, all conditions of the above-described (1) to (3) are satisfied, in which with regard to the product inductance (Ls), the crack occurrence rate, the change rate of the inductance value (L) and the molded body strength for these examples. So all of them are acceptable (see "○" in Table 1).

In addition, the gas permeability coefficient relates to the crack occurrence rate closely, in which in the inventive-examples A1 to A15, the gas permeability coefficient becomes at least 681 $cm^3 \cdot mm/(m^2 \cdot sec \cdot atm)$ (see the case of the inventive-example A15) and exceeds 600 $cm^3 \cdot mm/(m^2 \cdot sec \cdot atm)$. On the other hand, when the volume occupancy of the vacancy is 6-volume % (in case of the comparative-examples CA4, CA6, CA8), the gas permeability coefficient becomes at most 354 $cm^3 \cdot mm/(m^2 \cdot sec \cdot atm)$ (see the case of the comparative-example CA4). For this reason, there is remarkable difference of the gas permeability coefficient between the inventive-examples A1 to A15 in which the volume occupancy of the vacancy is 8-volume % or more and the comparative-examples CA4, CA6, CA8 in which the volume occupancy of the vacancy is smaller than 8-volume %, so that it is conceivable that the difference thereof affects the crack occurrence rate.

It should be noted that in the conventional example PA, the volume occupancy of the vacancy is 5-volume % and this value becomes the minimum value. For this reason, the gas permeability coefficient thereof becomes the lowest value of 206 $cm^3 \cdot mm/(m^2 \cdot sec \cdot atm)$ in Table 1.

Here, in Table 1, with regard to the comparative-examples CA5, CA7, CA9, the molded body strengths of the core 20 are unacceptable (see "x" in Table 1), but other items thereof are acceptable (see "○" in Table 1). For this reason, if there are satisfied the conditions in which the crack occurrence rate is supposed to be 0 in the MSL test and the change rate of the inductance value (L) is supposed to be a value less than the tolerance (−5% in Table 1) or less, and if the molded body strength of the core 20 is ensured by another technique (for example, by adding a reinforcement member or the like), these comparative-examples CA5, CA7, CA9 become also preferable.

In addition, in Table 1, with regard to the comparative-examples CA1 to CA3, each of the product inductances (Ls) becomes smaller than the threshold value for judgement (7 in Table 1) and these product inductances (Ls) become unacceptable. However, other items become acceptable (see "○" in Table 1). For this reason, if there are satisfied the conditions in which the crack occurrence rate is supposed to be 0 in the MSL test and the change rate of the inductance value (L) is supposed to be a value less than the tolerance (−5% in table 1) or less, and when it is allowed for the product inductance (Ls) to be a lower value, these comparative-examples CA1 to CA3 become also acceptable.

Inventive-Example B

In an inventive-example B, for the magnetic powders, there were used powders obtained by mixing Fe—Si—Cr-based alloy and Fe-based amorphous powders and further, for a binder resin, there was used a resin whose base is a product which is an epoxy resin manufactured by Japan Pelnox, Ltd., in which a mixture was obtained by mixing those above by a planetary mixer. Thereafter, by pressure-molding the mixture by using a mold, there was obtained a magnetic element 10 having a core 20. At that time, the measurement was carried out by changing the volume occupancy of the magnetic powders, the volume occupancy of the epoxy resin and the volume occupancy of the vacancy variously. It should be noted that the measurement items and the threshold values for judgement in such an inventive-examples B were selected to be similar as those in the above-described inventive-examples A. In addition, in the inventive-example B, the conditions other than the condition in which the binder resin was formed by an epoxy resin were selected to be similar as those of the case in Table 1. The results thereof are shown in Table 2.

TABLE 2

| Epoxy resin | | | | | | | | | | | | |
|---|---|---|---|---|---|---|---|---|---|---|---|---|
| Space Factor (Vol %) | | | | Gas Permeability | Inductance (μH) | | MSL Test | | | | | |
| | | | | | | | Crack | | Inductance | | Molded | |
| Metal Powders | Vacancy | Resin | Density g/cm³ | $cm^3 \cdot mm/(m^2 \cdot sec \cdot atm)$ | Result | Judgment | Occurrence Rate (%) | Judgment | Change Rate (%) | Judgment | Body Strength | Remarks |
| 58 | 8 | 34 | 4.75 | 731 | 6 | X | 0 | ○ | −3 | ○ | ○ | Comparative-Example CB1 |
| 58 | 20 | 22 | 4.6 | 5351 | 6 | X | 0 | ○ | −2 | ○ | ○ | Comparative-Example CB2 |
| 58 | 30 | 12 | 4.48 | 11936 | 6 | X | 0 | ○ | −3 | ○ | ○ | Comparative-Example CB3 |
| 60 | 6 | 34 | 4.9 | 345 | 8 | ○ | 75 | X | −23 | X | ○ | Comparative-Example CB4 |
| 60 | 8 | 32 | 4.87 | 668 | 8 | ○ | 0 | ○ | −4 | ○ | ○ | Inventive-Example B1 |
| 60 | 13 | 27 | 4.81 | 2002 | 8 | ○ | 0 | ○ | −3 | ○ | ○ | Inventive-Example B2 |
| 60 | 18 | 22 | 4.75 | 4402 | 8 | ○ | 0 | ○ | −3 | ○ | ○ | Inventive-Example B3 |
| 60 | 23 | 17 | 4.69 | 7245 | 8 | ○ | 0 | ○ | −3 | ○ | ○ | Inventive-Example B4 |
| 60 | 28 | 12 | 4.63 | 11056 | 8 | ○ | 0 | ○ | −2 | ○ | ○ | Inventive-Example B5 |
| 60 | 30 | 10 | 4.61 | 12193 | 8 | ○ | 0 | ○ | −2 | ○ | X | Comparative-Example CB5 |

TABLE 2-continued

| Epoxy resin | | | | | | | | | | | | |
|---|---|---|---|---|---|---|---|---|---|---|---|---|
| Space Factor (Vol %) | | | | Gas Permeability | Inductance (μH) | | MSL Test | | | | | |
| | | | | | | | Crack | | Inductance | | Molded | |
| Metal Powders | Vacancy | Resin | Density g/cm$^3$ | cm$^3$ · mm/ (m$^2$ · sec · atm) | Result | Judgment | Occurrence Rate (%) | Judgment | Change Rate (%) | Judgment | Body Strength | Remarks |
| 65 | 8 | 27 | 5.19 | 655 | 11 | ○ | 0 | ○ | −4 | ○ | ○ | Inventive-Example B6 |
| 65 | 13 | 22 | 5.13 | 2174 | 11 | ○ | 0 | ○ | −3 | ○ | ○ | Inventive-Example B7 |
| 65 | 18 | 17 | 5.07 | 4453 | 11 | ○ | 0 | ○ | −3 | ○ | ○ | Inventive-Example B8 |
| 65 | 23 | 12 | 5.01 | 6972 | 11 | ○ | 0 | ○ | −2 | ○ | ○ | Inventive-Example B9 |
| 70 | 6 | 24 | 5.52 | 347 | 11 | ○ | 90 | X | −24 | X | ○ | Comparative-Example CB6 |
| 70 | 8 | 22 | 5.5 | 728 | 15 | ○ | 0 | ○ | −4 | ○ | ○ | Inventive-Example B10 |
| 70 | 13 | 17 | 5.44 | 2120 | 15 | ○ | 0 | ○ | −3 | ○ | ○ | Inventive-Example B11 |
| 70 | 18 | 12 | 5.38 | 4481 | 15 | ○ | 0 | ○ | −2 | ○ | ○ | Inventive-Example B12 |
| 72 | 18 | 10 | 5.51 | 4092 | 17 | ○ | 0 | ○ | −3 | ○ | X | Comparative-Example CB7 |
| 75 | 8 | 17 | 5.81 | 654 | 19 | ○ | 0 | ○ | −3 | ○ | ○ | Inventive-Example B13 |
| 75 | 13 | 12 | 5.75 | 2177 | 19 | ○ | 0 | ○ | −2 | ○ | ○ | Inventive-Example B14 |
| 80 | 8 | 12 | 6.13 | 732 | 23 | ○ | 0 | ○ | −4 | ○ | ○ | Inventive-Example B15 |
| 82 | 6 | 12 | 6.28 | 329 | 23 | ○ | 85 | X | −19 | X | ○ | Comparative-Example CB8 |
| 82 | 8 | 10 | 6.25 | 691 | 24 | ○ | 0 | ○ | −4 | ○ | X | Comparative-Example CB9 |
| 70 | 5 | 25 | 5.54 | 215 | 15 | ○ | 90 | X | −22 | X | ○ | Conventional-Example PB |

As known from Table 2, in the inventive-examples B1 to B15, all conditions of the above-described (1) to (3) are satisfied, in which with regard to the product inductance (Ls), the crack occurrence rate, the change rate of the inductance value (L) and the molded body strength for these examples, all of them are acceptable (see "○" in Table 2).

In addition, in the inventive-examples B1 to B15, the gas permeability coefficient becomes at least 654 cm$^3$·mm/(m$^2$·sec·atm) (see the case of the inventive-example B13) and exceeds 600 cm$^3$·mm/(m$^2$·sec·atm). On the other hand, when the volume occupancy of the vacancy is 6-volume % (in case of the comparative-examples CB4, CB6, CB8), the gas permeability coefficient becomes at most 347 cm$^3$·mm/(m$^2$·sec·atm) (see the case of the comparative-example CB6). For this reason, there is remarkable difference of the gas permeability coefficient between the inventive-examples B1 to B15 in which the volume occupancy of the vacancy is 8-volume % or more and the comparative-examples CB4, CB6, CB8 in which the volume occupancy of the vacancy is smaller than 8-volume %, so that it is conceivable that the difference thereof affects the crack occurrence rate.

It should be noted that in the conventional example PB, the volume occupancy of the vacancy is 5-volume % and this value becomes the minimum value. For this reason, the gas permeability coefficient thereof becomes the lowest value of 215 cm$^3$·mm/(m$^2$·sec·atm) in Table 2.

As described in the above, it was found out, from the experimental results shown in Table 2, that there were obtained similar results as those shown in Table 1.

It should be noted that with regard to the comparative-examples CB5, CB7, CB9, also in Table 2 similar as Table 1, the molded body strengths of the core 20 are unacceptable (see "x" in Table 2), but other items thereof are acceptable (see "○" in Table 2). For this reason, if there are satisfied the conditions in which the crack occurrence rate is supposed to be 0 in the MSL test and the change rate of the inductance value (L) is supposed to be a value less than the tolerance (−5% in table 1) or less, and if the molded body strength of the core 20 is ensured by another technique (for example, by adding a reinforcement member or the like), these comparative-examples CB5, CB7, CB9 become also preferable.

In addition, in Table 2, with regard to the comparative-examples CB1 to CB3, each of the product inductances (Ls) becomes smaller than the threshold value for judgement (7 in Table 2) and these product inductances (Ls) become unacceptable. However, other items become acceptable (see "○" in Table 2). For this reason, if there are satisfied the conditions in which the crack occurrence rate is supposed to be 0 in the MSL test and the change rate of the inductance value (L) is supposed to be a value less than the tolerance (−5% in Table 2) or less, and when it is allowed for the product inductance (Ls) to be a lower value, these comparative-examples CB1 to CB3 become also preferable.

It should be noted that when considering the results of the abovementioned Table 1 and Table 2, each of the gas permeability coefficients in the inventive-examples A1 to A15 and the inventive-examples B1 to B15 becomes 500 cm$^3$·mm/(m$^2$·sec·atm) or more under the abovementioned measurement condition and the gas permeability coefficients thereof become remarkably higher than those in the comparative-examples CA1 to CA9 and the comparative-examples CB1 to CB9. It should be noted that each of the gas permeability coefficients in the inventive-examples A1 to A15 and the inventive-examples B1 to B15 satisfies the condition of 600 $cm^3 \cdot mm/(m^2 \cdot sec \cdot atm)$ or more, and further, satisfies the condition of 650 $cm^3 \cdot mm/(m^2 \cdot sec \cdot atm)$ or more. In addition, in the inventive-examples A1 to A15, the lowest value of the gas permeability coefficients becomes 681 $cm^3 \cdot mm/(m^2 \cdot sec \cdot atm)$ and in any of the inventive-examples A1 to A15, the gas permeability coefficient becomes a value equal to or higher than that lowest value. In addition, in the inventive-examples B1 to B15, the lowest value of the gas permeability coefficient becomes 654 $cm^3 \cdot mmh/(m^2 \cdot sec \cdot atm)$ and in any of the inventive-examples B1 to B15, the gas permeability coefficient becomes a value equal to or higher than that lowest value.

According to the magnetic element 10 having a constitution such as described above, the core 20 includes magnetic powders of volume occupancy within the range of 60-volume % to 80-volume % with respect to the whole volume of the aforesaid core 20, includes a binder resin of volume occupancy of 12-volume % or more with respect to the whole volume of the core 20, and further, includes vacancy of volume occupancy of 8-volume % or more with respect to the whole volume of the core 20. Then, the coil 30 which is formed by winding the conductive wire 31 is buried into this core 20.

For this reason, it becomes easily possible to discharge the moisture which entered into the inside of the core 20 even under a high temperature environment such as, for example, an environment of carrying out the solder reflow. In this manner, it is possible to prevent defects such as a defect in which a volume expansion occurs at the core 20, a defect in which a crack occurs at the core, and so on. In particular, when the coil 30 is formed by the conductive wire 31 including a fusion-bond layer, the fusion-bond layer thereof is rich in hygroscopicity, so that it is easy for the crack or the like to be caused at the core 20, but it becomes possible to satisfactorily prevent such a crack or the like from occurring.

Therefore, for the magnetic element 10 of this exemplified embodiment, it becomes possible to realize a magnetic element which can clear such a requirement as of the level 1 of the MSL test that the solder reflow could be carried out without any problem even if being left as it is under the external environment without any time limit.

In addition, the occurrence of the crack or the like is prevented in the core 20, so that it becomes possible to prevent such a defect that the inductance of the magnetic element 10 would decrease or the like.

In addition, according to this exemplified embodiment, assuming that the total volume occupancy of the magnetic powders, the binder resin and the vacancy is 100-volume %, the core 20 is formed such that the volume occupancy of the binder resin is within the range of 12-volume % to 32-volume % with respect to the whole volume, and the volume occupancy of the vacancy becomes within the range of 8-volume % to 28-volume % with respect to the whole volume. For this reason, as mentioned in the inventive-examples A and the inventive-examples B, it is possible to heighten the product inductance (Ls) more than the threshold value for judgement and in addition, it is possible to suppress the occurrence of the crack in the core 20. Further, it is also possible to reduce the change rate of the inductance value (L) and in addition, it is possible to secure the strength of the core 20 which is a molded body.

Further, in this exemplified embodiment, the binder resin is formed by a silicone resin or an epoxy resin. For this reason, it becomes possible to secure the strength of the core 20 after molding and concurrently, it is possible to secure the heat resistance. In particular, a silicone resin is excellent in heat resistance compared with an epoxy resin, so that when the silicone resin is used, for example, in an electronic component or the like for a vehicle which requires a high heat resistance, the silicone resin is more preferable than the epoxy resin.

In addition, according to this exemplified embodiment, for any of the magnetic elements 10 in the inventive-examples A and the inventive-examples B, the gas permeability coefficient becomes 600 $cm^3 \cdot mm/(m^2 \cdot sec \cdot atm)$ or more. For this reason, the fusion-bond layer of the conductive wire 31, the core 20 and the like will absorb the moisture, so that even if the solder reflow is carried out directly without applying any countermeasure, it becomes possible to prevent a crack or the like from occurring in the core 20.

Further, in this exemplified embodiment, it is preferable to set the volume occupancy of the magnetic powders to be within the range of 65-volume % to 75-volume %. In case of selecting this range, as known from the inventive-examples A and the inventive-examples B, it is possible to increase the product inductance (Ls) value as much as around 1.5 times compared with a case in which the percentage of the magnetic powders is 60-volume %. In addition, with regard to the volume occupancy of at least one of the binder resin and the vacancy, it is possible to set the value thereof to be larger than the lower limit within the each permissible range and due to this fact, it is possible to make at least one of the gas permeability and the strength of the molded body of the core 20 more favorable.

Further, in the invention of the magnetic element of the present invention, the magnetic element 10 further includes the terminal unit 40. More specifically, the terminal unit 40 is electrically connected to the terminal end 31*a* and is attached to the outer circumferential surface of the core 20, and concurrently, is attached in a state of being electrically connected with respect to an external mounting substrate. For this reason, it is possible to realize the magnetic element 10 by an SMD (Surface-Mount-Device) type and when carrying out the solder reflow or the like, it becomes possible to mount the magnetic element 10 onto the mounting substrate.

Modified Example

As described above, there was explained one exemplified embodiment of the present invention, but besides this embodiment, the present invention can be variously modified. Hereinafter, this matter will be described.

In the above-described exemplified embodiment, the total volume occupancy of the three factors of the magnetic powders, the binder resin and the vacancy is selected to be 100-volume % (the whole volume) for the core 20 volume. However, if the abovementioned conditions (1) to (3) are satisfied, it is allowed for the total volume occupancy of these three factors to be smaller than 100-volume %. More specifically, it is allowed for the core 20 to have another configuration which includes another factor other than the abovementioned three factors.

In addition, in the above-described exemplified embodiment, the core 20 which includes a desired vacancy rate was formed by compression-molding a mixture of magnetic powders and a binder resin. However, it is allowed to form the core 20 by a manufacturing method other than the compression molding. For example, it is allowed to employ a method in which after a soluble solvent-soluble-type polyimide which is also provided with the heat resistance is mixed, the core 20 is pressure-mold and thereafter, a vacancy is to be formed in the core 20 by dissolving the solvent-soluble-type polyimide by an organic solvent.

In addition, in the above-described exemplified embodiment, for a magnetic element, there is applied the description by citing an inductor as an example. However, with regard to the magnetic element, it is allowed to apply the present invention to a transformer or the like.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A magnetic element comprising:

a core, the core including:

magnetic powders of volume occupancy being within a range of 60-volume % to 80-volume % with respect to a core volume of the core;

a binder resin of volume occupancy being within a range of 12-volume % to 32-volume % with respect to the core volume; and vacancy of volume occupancy being within a range of 8-volume % to 28-volume % with respect to the core volume; and a coil which is formed by winding a conductive wire and is embedded into the core, wherein the core is generally a rectangular parallelepiped having an outer circumferential surface, the outer circumferential surface of the core configures an external surface of a main body of the magnetic element, and a gas permeability coefficient of the core is at least 600 $cm^3 \cdot mm/(m^2 \cdot sec \cdot atm)$.

2. The magnetic element according to claim 1, wherein the binder resin is one of a silicone resin and an epoxy resin.

3. The magnetic element according to claim 2, wherein the volume occupancy of the magnetic powders is within a range of 65-volume % to 75-volume %.

4. The magnetic element according to claim 3, further comprising:

a terminal which is electrically connected to a terminal-end of the coil and is attached to the outer circumferential surface of the core, wherein the terminal is electrically connectable to an external mounting substrate.

5. The magnetic element according to claim 2, further comprising:

a terminal which is electrically connected to a terminal-end of the coil, the terminal being attached to the outer circumferential surface of the core, wherein the terminal is electrically connectable to an external mounting substrate.

6. The magnetic element according to claim 1, further comprising:

a terminal which is electrically connected to a terminal-end of the coil, the terminal being attached to the outer circumferential surface of the core, wherein the terminal is electrically connectable to an external mounting substrate.

7. The magnetic element according to claim 6, wherein the volume occupancy of the magnetic powders is within a range of 65-volume % to 75-volume %.

8. The magnetic element according to claim 1, wherein the volume occupancy of the magnetic powders is within a range of 65-volume % to 75-volume %.

9. The magnetic element according to claim 8, further comprising:

a terminal which is electrically connected to a terminal-end of the coil, the terminal being attached to the outer circumferential surface of the core, wherein the terminal is electrically connectable to an external mounting substrate.

* * * * *